US010738471B2

(12) United States Patent
Gonzalez

(10) Patent No.: US 10,738,471 B2
(45) Date of Patent: Aug. 11, 2020

(54) APPARATUS TO POSITION REINFORCING BARS AND PREVENT INJURY

(71) Applicant: William Shubert, Highland, CA (US)

(72) Inventor: Frank Gonzalez, Apple Valley, CA (US)

( * ) Notice: Subject to any disclaimer, the term of this patent is extended or adjusted under 35 U.S.C. 154(b) by 0 days.

(21) Appl. No.: 16/168,814

(22) Filed: Oct. 23, 2018

(65) Prior Publication Data

US 2019/0127981 A1 May 2, 2019

Related U.S. Application Data

(60) Provisional application No. 62/577,713, filed on Oct. 27, 2017.

(51) Int. Cl.
*E04C 5/16* (2006.01)
*E04C 5/20* (2006.01)

(52) U.S. Cl.
CPC ..... *E04C 5/161* (2013.01); *E04C 5/205* (2013.01)

(58) Field of Classification Search
CPC ..... E04C 5/161; E04C 5/205; E04C 5/162; E04C 5/168; E04C 5/20
See application file for complete search history.

(56) References Cited

U.S. PATENT DOCUMENTS

| | | | | |
|---|---|---|---|---|
| 1,070,921 | A * | 8/1913 | Saltiel | E04C 5/168 264/35 |
| 5,216,866 | A * | 6/1993 | Ekedal | E04C 5/168 52/677 |
| 5,447,290 | A * | 9/1995 | Workman | E04C 5/161 256/59 |
| 5,456,051 | A * | 10/1995 | Queen | E04C 5/20 52/677 |
| 5,826,398 | A | 10/1998 | Carnicle | |
| 5,950,680 | A | 9/1999 | Randall | |
| 6,073,415 | A * | 6/2000 | Carnicle | E04C 5/161 256/59 |
| 6,199,333 | B1 | 3/2001 | Viduka, Jr. | |
| 6,898,915 | B2 * | 5/2005 | Hancock | E02D 27/02 249/3 |
| 8,122,675 | B2 | 2/2012 | Ripley et al. | |
| 8,973,323 | B1 | 3/2015 | McDonald | |
| 2005/0133684 | A1 | 6/2005 | Maguire | |
| 2015/0121785 | A1 * | 5/2015 | Hewlett | E04C 5/161 52/301 |
| 2015/0284958 | A1 | 10/2015 | Hutchison et al. | |

* cited by examiner

*Primary Examiner* — Patrick J Maestri
(74) *Attorney, Agent, or Firm* — Kenneth Avila

(57) ABSTRACT

Disclosed is an apparatus to reduce the amount of time required to assemble an array of construction reinforcing bars wherein a consistent gap is present between the reinforcing bars and the height of the exposed end of the reinforcing bars is substantially identical while simultaneously covering the exposed ends of the reinforcing bars to prevent injuries to nearby individuals that may come into contact with the exposed ends of the reinforcing bars.

5 Claims, 5 Drawing Sheets

APPARATUS TO POSITION REINFORCING BARS AND PREVENT INJURY

CROSS-REFERENCE TO RELATED APPLICATIONS

This application claims priority from U.S. Provisional Patent Application No. 62/577,713 filed on Oct. 27, 2017. The entire disclosure of the prior application is considered to be part of the disclosure of the accompanying application and is hereby incorporated by reference.

BACKGROUND OF THE INVENTION

1. Field of the Invention

The present invention relates generally to the field of reinforcing bar ("rebar") positioners, apparatus that aid in reducing the amount of time required to build a rebar assembly; and rebar safety cover, apparatus to aid in the protection of construction workers on the job site. As an apparatus for positioning rebar, means are provided to allow for and maintain the proper spacing between adjacent and linearly arranged individual rebars. As an apparatus for protecting construction workers on the job site, means are provided to cover the exposed ends of the rebar so as to prevent the impalement of workers falling onto the exposed end or to prevent workers from being cut by any sharp edges existing on the exposed end of the rebar.

2. Description of the Related Art

Rebar is a steel bar used as a tension device in reinforced concrete and reinforced masonry structures to strengthen and aid the concrete under tension. Concrete is strong under compression, but has weak tensile strength. Rebar significantly increases the tensile strength of the structure and its surface is irregular so as to improve the bonding between the rebar and the concrete.

In construction projects that utilize masonry blocks, a footing is dug and rebar is placed horizontally within the footing and vertically extending above the footing. The horizontal rebar provides tensile strength to the footing while the vertical rebar is used to provide tensile strength to the masonry blocks placed on the footing that form the wall supported by the footing. Masonry blocks have hollow cores to allow the vertical rebar to pass through. Preferably the vertical rebar is arranged so that it will pass through the center of the masonry block's hollow core to provide added strength and stability to the wall. In order to hold the vertical rebar in position during the pouring of the concrete, the prior art typically utilized steel tie wires, in combination with stakes, to connect the vertical rebar to an underlying wood frame member or to the horizontal rebar to hold the vertical rebar in place during the pouring. After the pouring has completed and while the concrete is drying, caps are placed over the exposed ends of the vertical rebar to protect workers from injury by cuts or impalement. After the concrete has dried, the base layers of masonry blocks that begin the formation of the wall are guided through the vertical rebar. If the mason has done his/her job well, the masonry blocks will lay adjacent to each other with the vertical rebars protruding through the hollow core of the masonry blocks in a straight line, perpendicular as to the ground, and extending to identical heights above the ground. However, many times this is not the case as the vertical rebar extend to different heights and at different angles from each other. As a result, the exposed ends of the rebar must be covered by individual caps rather than using a single beam that covers multiple exposed ends or the unaligned rebar prevent the masonry blocks from being placed adjacent to each other.

U.S. Pat. No. 5,216,866 to Ekedal discloses a rebar spacer device which is used to set the rebar without using a tape. The device has an L-shaped track with scribe marks at predetermined intervals on the top. The track further has integral upper and lower rails which have elongated cut-out on the edge. A plurality of rebar holder slidingly engaged to the track wherein each holder has clamping section for securing the rebar in place; Each holder further has grooves on the top and bottom portions wherein the grooves are complementary to the upper and lower rails and mate with these rails when the rebar holders are mounted on the track. The track itself is mounted to a wood frame. Although the Ekedal device insures that the horizontal space between each rebar is correct; the Ekedal device does not insure that the vertical height of the rebars is the same, the grooves on the rails may become clogged with construction material such as concrete, the holders require effort to be engaged with or disengaged from a rebar, and the Ekedal device does not protect workers from the exposed ends of the vertically extending rebars.

U.S. Pat. No. 5,447,290 to Workman discloses a guard rail for use with linearly-arranged set of rebars. The guard rail including a housing for guarding rebars with the housing including structure for capturing the rebars therein, and structure on the capturing structure for guiding movement of the capturing structure between a non-secured position and a position wherein the housing is securely maintained in a guarding position over the rebars extending into the housing. Although the Workman guard rail protects workers from injuries caused by the exposed ends of the rebar, the Workman guard rail does not assist in the construction of the linearly-arranged set of rebars. Moreover, if the rebars are of varying height they will have to be trimmed to the height of the lowest rebar. Finally, if the rebars does not extend perpendicularly from the ground they will have to be brought into alignment prior to using the Workman guard rail.

U.S. Pat. No. 8,122,675 to Ripley et al. discloses a rebar positioner configured for being placed in a diagonal orientation within a cell of a masonry block including first and second end sections oriented in a first plane, a center S-shaped section in a second plane parallel to the first, laterally offset linear sections oriented in the second plane, and first and second vertical sections interconnecting the first and second end sections with the first and second linear sections, wherein the second end section terminates in a telltale extending away from the center section. If the mason performed their job well, the vertical rebar would extend directly through the center of the masonry block and there would be no need for the Ripley positioner. If the mason performed their job poorly, the vertical rebar would extend too far off center for the Ripley positioner to be of use. In addition, the Ripley positioner does not assist the mason in installing the rebar with the proper spacing between rebar. Finally, the Ripley positioner does not protect workers from injuries caused by the exposed end of the rebar.

Known rebar apparatuses do not provide a means for assisting the mason in positioning the rebar at appropriate intervals during construction while at the same time protecting workers from injuries caused by the exposed end of the rebar.

BRIEF SUMMARY OF THE INVENTION

The present disclosure discloses an apparatus for masons that allows the mason to perform their duties more efficiently to be referred to as the corrector while at the same time protecting masons and other workers from the dangers brought by the exposed ends of vertical rebar to be referred to as the protect.

The corrector is an elongated rectangular object with grooves in the form of partial right cylinders with the height of the groove being the same as the radius of the cylinder on one side that are equally spaced apart from each other. The protector is also an elongated rectangular object but with first cylindrical holes on one side that extend partially into the rectangular object and are equally spaced apart from each other with the same spacing as the grooves in the corrector. The rebar may be tied to the corrector using the same class of tie wires that are currently used by masons to tie rebar. Likewise rebar may be tied to the protector using the same class of tie wires that are currently used by masons to tie rebar. To simplify tying the rebar to the protector a second cylindrical hole that is proximate and perpendicular to the first cylindrical hole and extends through the rectangular object may be utilized.

It is an object of the invention to provide a mason with an apparatus to build a linear arrangement of rebar with a set distance between individual rebar quickly.

It is an object of the invention to protect the mason and other workers nearby from injury caused by contact with the exposed end of the rebar.

It is an object of the invention for the corrector not to be susceptible to being rendered inoperable by construction materials such as concrete.

It is an object of the invention for the corrector and protector to be connected to adjacent corrector and protectors to position and protect a longer linear arrangement of rebar.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

Neither this summary nor the following detailed description defines or limits the invention. The invention is defined by the claims.

BRIEF DESCRIPTION OF DRAWINGS

The present invention will become more fully understood from the detailed description and accompanying drawings, wherein.

DETAILED DESCRIPTION OF THE INVENTION

The following detailed description of the invention references the accompanying drawings that illustrate specific embodiments in which the invention can be practiced. The embodiments are intended to describe aspects of the invention in sufficient detail to enable those skilled in the art to practice the invention. Other embodiments can be utilized and changes can be made without departing from the scope of the present invention. The following detailed description is, therefore, not to be taken in a limiting sense. The scope of the present invention is defined only by the appended claims, along with the full scope of equivalents to which such claims are entitled.

Figure 1:
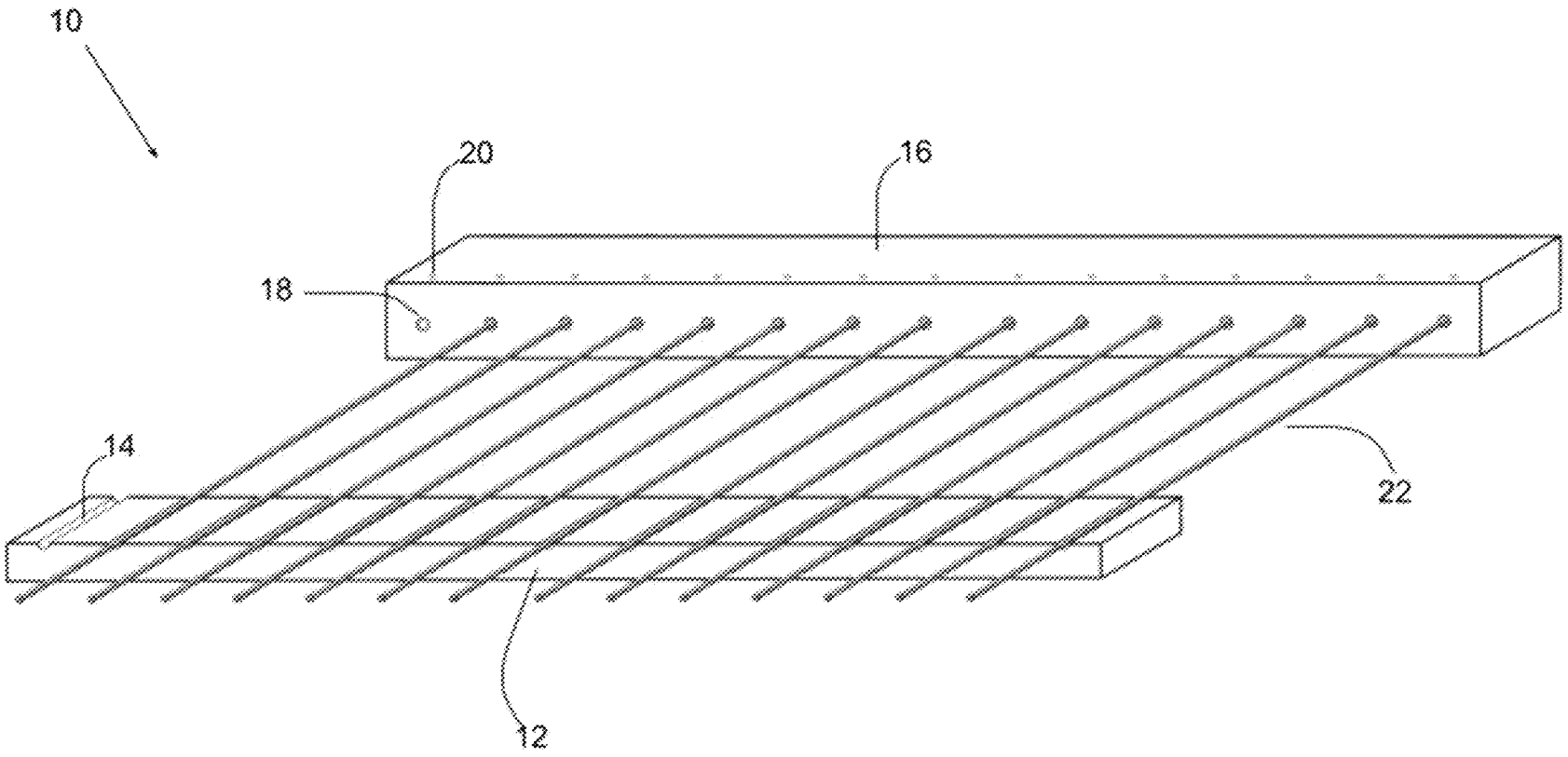
FIG. 1 shows an isometric view of the corrector and protector, with rebar positioned accordingly, according to the present invention.
Figure 2:
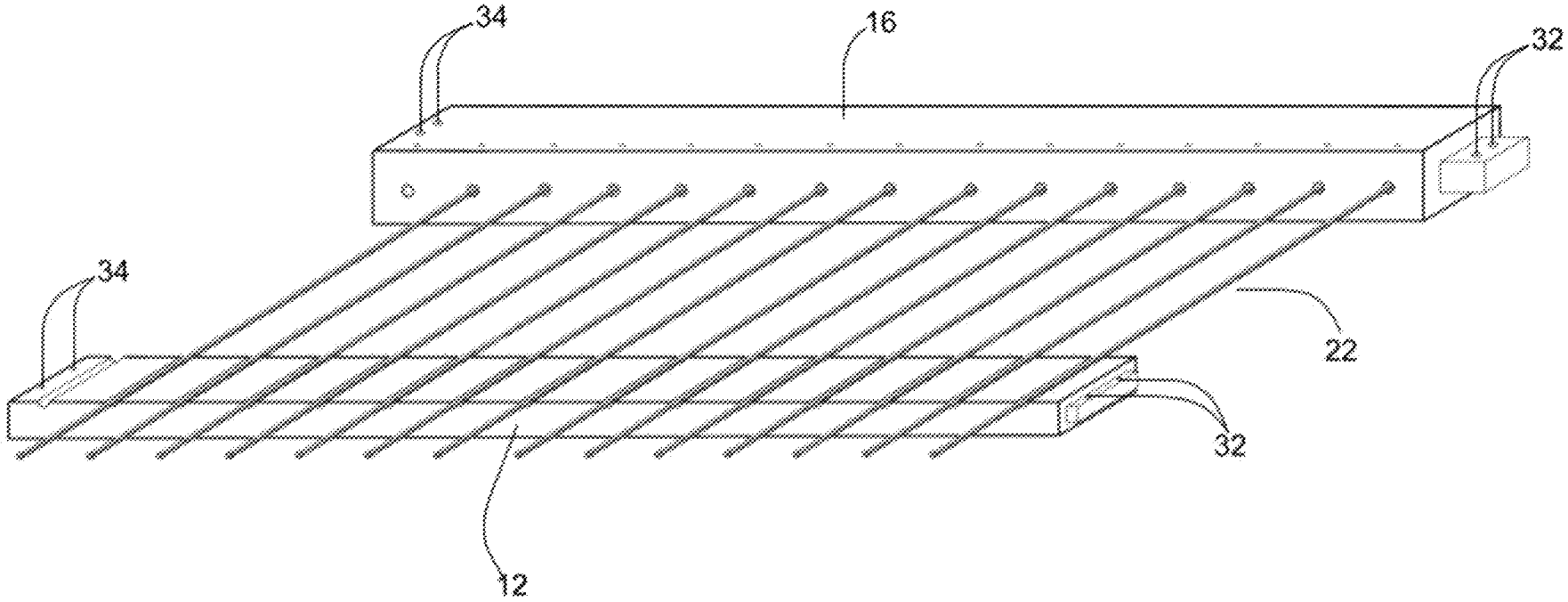
FIG. 2 shows an isometric view of the corrector and protector, with rebar positioned accordingly, with a means to connect adjacent correctors and protectors, according to an embodiment the present invention.

Referring now to FIG. 1, the primary embodiment, is disclosed corrector 12, a number of rebar 22, and protector 16. Corrector 12 is an elongated rectangular block with channels 14 cut into the rectangular block at set intervals, preferable every 4 inches. Channels 14 are in the form of a partial right cylinder where the height of channel 14 is equal to the radius of the cylinder. Channels 14 may also be cut into the rectangular block at other set intervals such as 8 or 12 inches. Channels 14 are used to insure that rebar 22 is positioned accordingly to the needs of the construction project. Once rebar 22 has been positioned within a channel 14, rebar wire ties may be used to ensure that rebar remains attached to corrector 12 when corrector 12 is moved or lifted. Protector 16 is also an elongated rectangular block containing cavities 18 at set intervals, preferable every 4 inches, along one side of the rectangular block. Cavities 18 may also be formed into the rectangular block at other set intervals such as 8 or 12 inches. Cavities 18 are cylindrical, void, and extend into protector 16 so as to allow the distal end of rebar 22 to be inserted therein. Typically, cavities 18 protrude some 4 inches into protector 16. Proximate to each cavity 18 are passages 20 which extend through protector 16 at an angle perpendicular to cavities 18. Rebar wire ties may be inserted through protector 16 via passages 20 and wrapped about rebar 22 to temporarily connect rebar 22 to protector 16. FIG. 1 also shows the planes used for height H and width W of protector 16. The same planes for height and width are also used with corrector 12, FIG. 2 shows an alternate embodiment of the invention in that corrector 12 and protector 16 have appropriate male and female connection at either end so that more than one corrector 12 and protector 16 may be joined together when desired. There are a variety of means of accomplishing this and FIG. 2 shows only one such mean. Shown in FIG. 2 at one end of both corrector 12 and protector 16 are male fittings that may be inserted into appropriately sized female fittings at the opposite end. The female fittings are not shown. The male fittings have holes 32 that align with holes 34 present at the female fittings so that bolts may extend through both the female and male fittings so as to join them.

Figure 3:
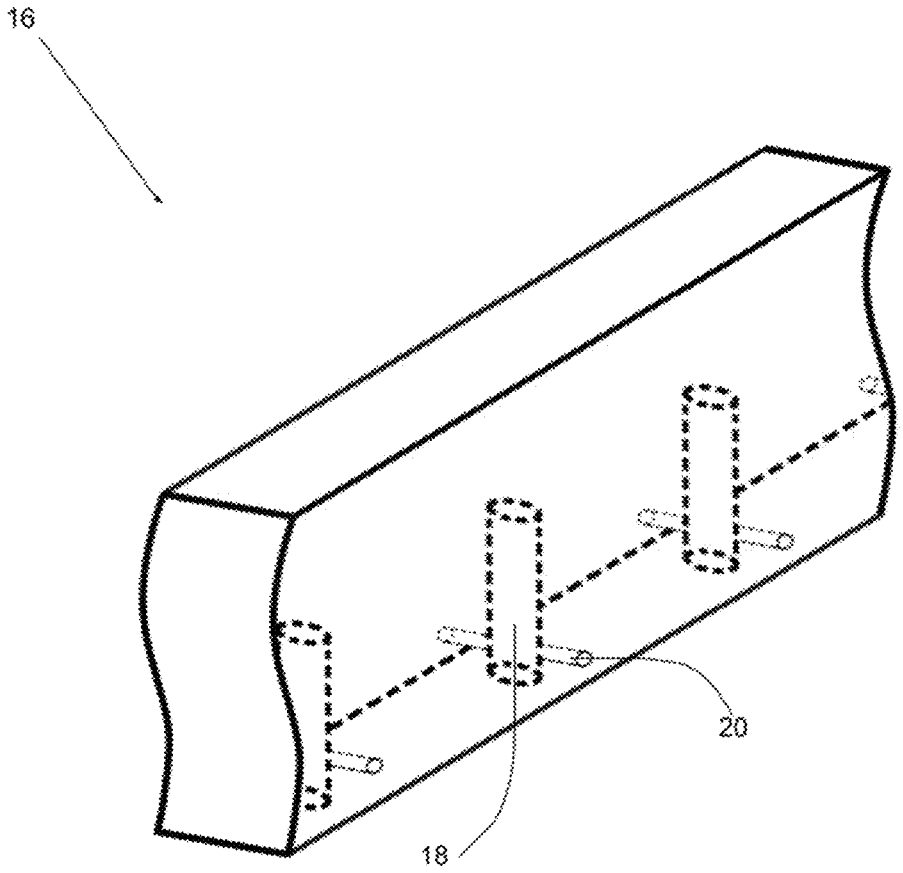
FIG. 3 shows the internal structure of the protector.
Figure 4:
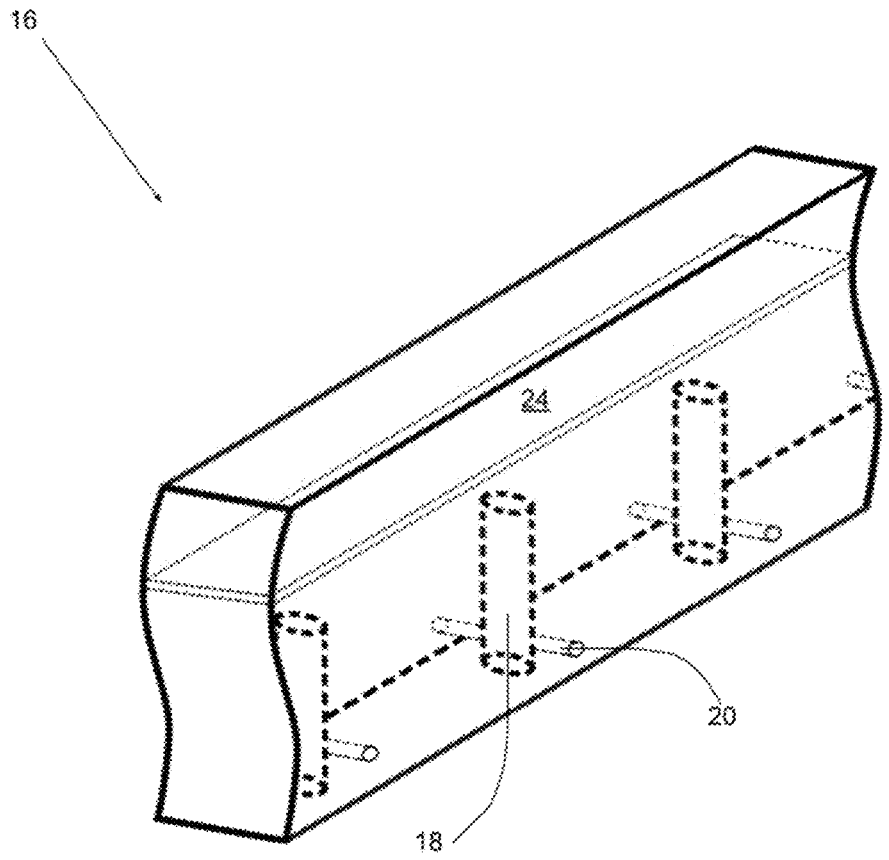
FIG. 4 shows the internal structure of the protector along with a safety cap as an alternate embodiment of the protector.

FIGS. 3 and 4 shows a detail view of a section of protector 16. In these figures it is shown that cavity 18 extends through only a portion of protector 16 and that passage 20 extends completely through protector 16 and is proximate to cavity 18 and perpendicular thereto. FIG. 4 shows an alternate embodiment of protector 16 where above cavities 18 is cap 24. Cap 24 is a reinforced section of protector 16 that prevents rebar 22 from punching through cavity 18 and out of protector 16. Cap 24 may extend through protector 16 as shown in FIG. 4 or may, only be positioned above each cavity 18.

Figure 5:
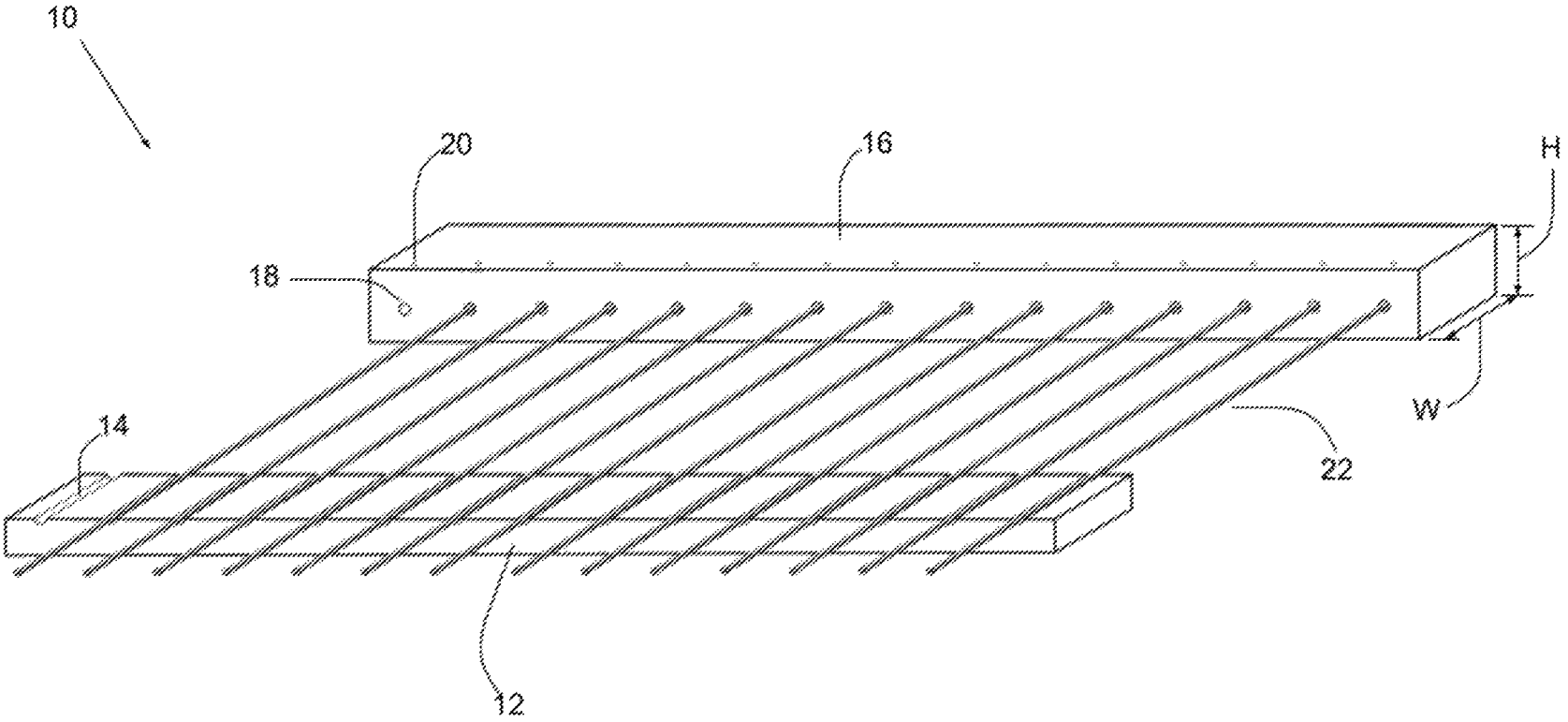
FIG. 5 shows a method of using the corrector and the protector.

FIG. 5 shows method 100 of using corrector 12 and protector 16 to ensure equal spacing between rebar 22 and to cover the distal end of rebar 22 so that individuals that are nearby are not injured by contact. In step 102 the distal end of rebar 22 is inserted into cavity 18 at the appropriate spacing. In 104, rebar wire tie is inserted through passage 20 and wrapped about rebar 22 to join rebar 22 to protector 16. In 106, corrector 12 is aligned with protector 16 to maximize overlap between the two and to rest rebar 22 within channels 14. In 108, rebar wire tie is wrapped about both corrector 12 and rebar 22 to join the two together. In 110, the assembly is positioned over the footing and secured by metal stakes and rod pins as the concrete is poured and cured. After pouring the concrete, 112, and it has cured, 114, corrector 12 and joined rebar 22 may be separated by cutting the rebar wire tie, 116. Protector 16 is removed only when masonry blocks are to be passed through the rebar or when exposed ends of the rebar has been cut down to beneath the masonry blocks.

While the invention has been described with reference to its preferred embodiments, it will be understood by those skilled in the art that various changes may be made and equivalents may be substituted for elements thereof without departing from the true spirit and scope of the invention. In addition, many modifications may be made to adapt a particular situation or material to the teachings of the invention without departing from its essential teachings.

What is claimed is:

1. An apparatus to position reinforcing bars at equal distance from each other while covering the exposed end of the reinforcing bars to prevent injuries from being caused thereby the apparatus comprising:

a first elongated rectangle having:

a certain height, width, and length;

a top surface; and one or more channels equally spaced along the top surface and perpendicular to the longitudinal axis so that reinforcing bars may be placed lengthwise along the channels;

a second elongated rectangle having:

a certain height, width, and length;

a top and a bottom surface with one or more hollow passages to allow the top surface to communicate with the bottom surface;

a side surface with one or more cavities having an open proximal end and a closed distal end the cavity protruding into the second elongated rectangle and is suitable for receiving the end of a reinforcing bar;

one or more wire ties to temporarily join the reinforcing bars to the first elongated rectangle and one or more wire ties each being inserted through said passage and wrapped about the end of reinforcing bar that has been inserted into said cavity to temporarily join the reinforcing bars to the second elongated rectangle so that the first elongated rectangle, second elongated rectangle, and the reinforcing bars may be moved about as an assembly.

2. The first elongated rectangle of claim 1 wherein the channels are voids in the form of partial right cylinders.

3. The second elongated rectangle of claim 1 wherein a cap abuts the distal end of each cavity to prevent penetration by any reinforcing bar that has been inserted into the cavity beyond the distal end of the cavity.

4. The cap of claim 3 wherein the cap is formed from metal.

5. The apparatus of claim 1 wherein the ends of the first and second elongated rectangles are configured to join with the ends of adjacent first and second elongated rectangles.

* * * * *